US006959834B2

(12) United States Patent
McDonald

(10) Patent No.: US 6,959,834 B2
(45) Date of Patent: Nov. 1, 2005

(54) WINDOWLESS TISSUE CARTON

(75) Inventor: Duane Lyle McDonald, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 72 days.

(21) Appl. No.: 10/383,432

(22) Filed: Mar. 6, 2003

(65) Prior Publication Data

US 2004/0178210 A1 Sep. 16, 2004

(51) Int. Cl.[7] ..... B65H 1/00
(52) U.S. Cl. ..... 221/63; 206/494
(58) Field of Search ..... 221/45, 48, 63, 221/55, 303; 206/449, 494, 554

(56) References Cited

U.S. PATENT DOCUMENTS

| | | | | |
|---|---|---|---|---|
| 2,840,266 | A | | 6/1958 | Nelson |
| 2,840,267 | A | | 6/1958 | Nelson |
| 3,684,086 | A | | 8/1972 | Harrison |
| 3,979,019 | A | | 9/1976 | Bliss |
| 4,200,200 | A | * | 4/1980 | Hein et al. ..... 221/48 |
| 4,254,173 | A | | 3/1981 | Peer |
| 4,409,275 | A | | 10/1983 | Samowich |
| 4,411,374 | A | | 10/1983 | Hotchkiss |
| 4,460,088 | A | | 7/1984 | Rugenstein et al. |
| 4,681,240 | A | | 7/1987 | Wyant |
| 4,785,970 | A | | 11/1988 | Engelmayer |
| 4,807,745 | A | | 2/1989 | Langley et al. |
| 4,863,064 | A | * | 9/1989 | Dailey, III |
| D316,201 | S | | 4/1991 | Shimasaki |
| 5,219,421 | A | | 6/1993 | Tipping |
| 5,316,177 | A | | 5/1994 | Boldt |
| 5,415,320 | A | * | 5/1995 | North et al. |
| D379,044 | S | | 5/1997 | Collins |
| 5,632,402 | A | | 5/1997 | Walsh et al. |
| 5,632,404 | A | | 5/1997 | Walsh |
| 5,733,634 | A | | 3/1998 | Karel |
| 5,783,030 | A | | 7/1998 | Walsh |
| 5,794,811 | A | | 8/1998 | Walsh |
| 5,794,812 | A | | 8/1998 | Walsh |
| 5,906,278 | A | * | 5/1999 | Ponsi et al. ..... 206/494 |
| 5,968,636 | A | | 10/1999 | Sinclair et al. |
| 6,030,477 | A | | 2/2000 | Olvey |
| 6,053,357 | A | | 4/2000 | Yoh |
| 6,202,889 | B1 | | 3/2001 | Veith |
| 6,412,656 | B1 | | 7/2002 | Placik |
| 6,523,690 | B1 | * | 2/2003 | Buck et al. ..... 206/494 |
| 6,612,462 | B2 | * | 9/2003 | Sosalla et al. ..... 221/48 |
| 2004/0166258 | A1 | | 8/2004 | Mau et al. |

FOREIGN PATENT DOCUMENTS

| | | | |
|---|---|---|---|
| CA | 2003256 | * | 5/1990 |
| DE | 38 39 180 C1 | | 1/1990 |
| EP | 0 573 782 A2 | | 12/1993 |
| EP | 1 072 534 A1 | | 1/2001 |
| GB | 476900 | * | 12/1937 |
| WO | WO 02/058524 A2 | | 8/2002 |

* cited by examiner

*Primary Examiner*—Kenneth Noland
(74) *Attorney, Agent, or Firm*—Scott A. Baum

(57) ABSTRACT

A windowless tissue carton comprises, in one embodiment, a film aperture having a printed design such that the interior of the carton is not visible through a colorless transparent plastic window.

48 Claims, 4 Drawing Sheets

WINDOWLESS TISSUE CARTON

BACKGROUND

Tissue cartons for containing tissues are often formed from a board substrate that has a colorless transparent dispensing window adhered to an interior surface of the carton. The exterior surface of the carton is often printed with various designs to make the carton more attractive. In spite of the manufacturer's best efforts to produce a wide array of pleasing designs, often the tissue cartons are hidden from view or placed within or under a dispensing cover to hide the tissue carton. One possible explanation for hiding the carton is that the colorless transparent window, while utilitarian in assisting during dispensing of the tissues, interrupts the printed design and appears as a large, gapping hole in the carton's exterior. The dispensing window allows for undesirable observation of the brown unprinted carton interior, especially as the tissue becomes nearly depleted. Furthermore, the dispensing window is not integrated with the printed design of the carton. Thus, there is a need to either hide the dispensing window or to integrate the window with the overall design of the carton.

SUMMARY

The inventor has discovered that by redesigning the carton and printing the film aperture forming the dispensing window, the dispensing window can be hidden from view and integrated with the overall design of the carton. Thus, more attractive cartons are produced reducing or eliminating the need to hide the tissue carton from view.

Hence, in one aspect, the invention resides in a carton blank comprising a substrate having an interior surface, an exterior surface and a cutout; a film having an inner surface, an outer surface, and a film aperture; the inner surface of the film adhered to exterior surface of the substrate covering at least a portion of the exterior surface and the cutout; and the film aperture positioned above the cutout.

In another aspect the invention resides in, a product comprising a substrate forming a carton having an interior surface, an exterior surface; a cutout in the substrate; a film having an inner surface, an outer surface, and a film aperture; the inner surface of the film adhered to exterior surface of the substrate covering at least a portion of the exterior surface and the cutout, and the film aperture positioned above the cutout; and a plurality of tissue sheets within the carton.

In another aspect the invention resides in a product comprising a windowless tissue carton, containing a plurality of tissue sheets, comprising a film aperture having a printed design.

BRIEF DESCRIPTION OF THE DRAWINGS

The above aspects and other features, aspects, and advantages of the present invention will become better understood with regard to the following description, appended claims, and accompanying drawings:

DEFINITIONS

As used herein, "film aperture" comprises films which contain an opening such as round, oval, x-shaped, a slit, or other shape, or films having perforations that can be split to form an opening, or films that are splitable to form an opening upon application of finger pressure to the film as disclosed in U.S. Pat. No. 4,200,200 entitled *Sheet Dispensing Carton*, and herein incorporated by reference in a consistent manner.

As used herein, forms of "comprise", "have" and "include" are legally equivalent and are open-ended. Therefore, in the claims additional non-recited elements, functions, steps or limitations may be present in addition to the recited elements, functions, steps, or limitations.

DETAILED DESCRIPTION

Figure 1:
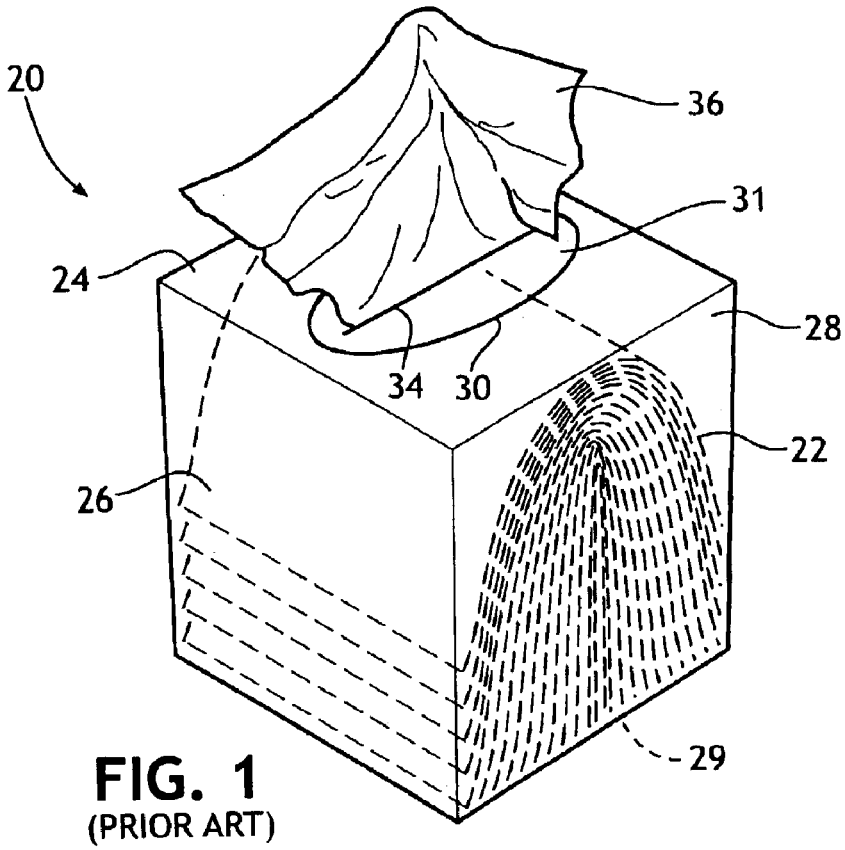
FIG. 1 (PRIOR ART)
FIG. 1 illustrates a prior art tissue carton.

Referring now to FIG. 1, a prior art tissue carton 20 housing a u-shaped clip of interfolded tissues 22 is illustrated. The carton comprises a top wall 24 and four sidewalls (sidewalls 26 and 28 shown) and a bottom wall 29. Located in the top wall is a cutout opening 30 that is typically die cut from the substrate forming the carton. Attached to an interior surface of the top wall is a colorless transparent window 31 having a slit 34. The colorless window permits observation of the carton's interior and the u-shaped clip through the plastic film. The colorless window is supplied to prevent a partially dispensed tissue sheet 36 from falling back to within the carton's interior so it can be readily grasped when needed.

Figure 2:
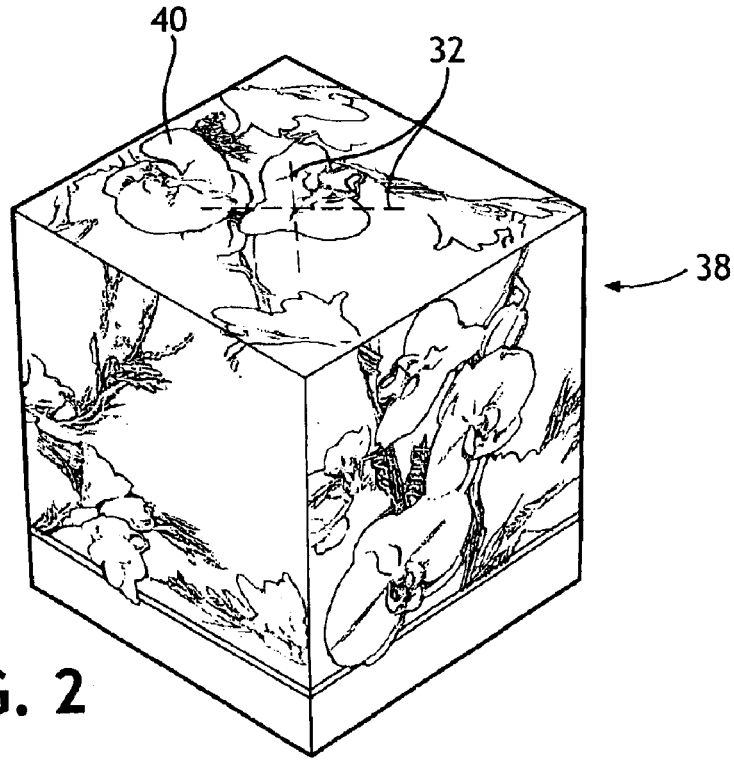
FIG. 2 illustrate one embodiment of the invention.
Figure 3:
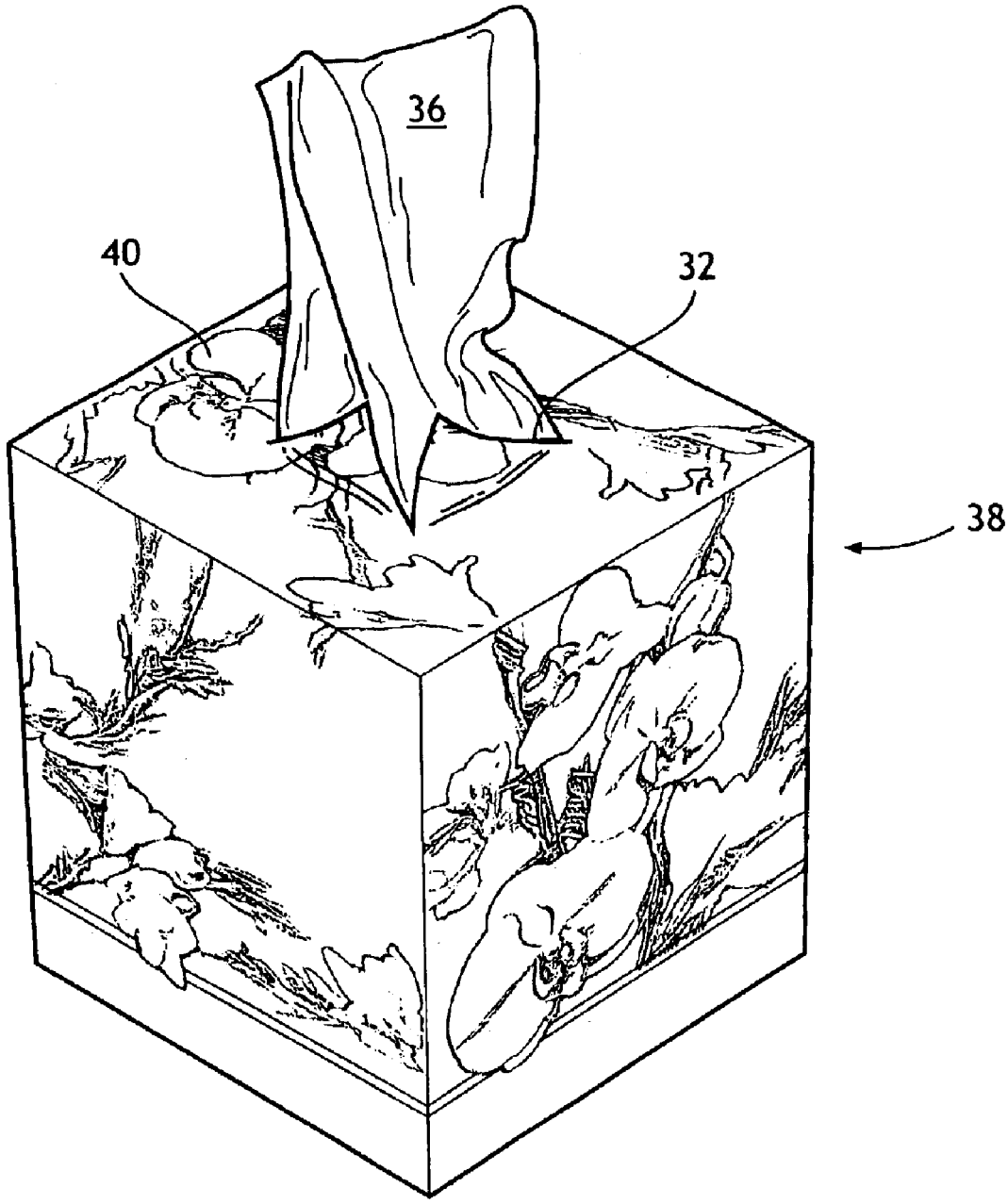
FIG. 3 illustrates the embodiment of FIG. 2 dispensing a tissue sheet.

Referring now to FIGS. 2 and 3, one embodiment of the invention is illustrated. A windowless tissue carton 38 has a design 40 printed onto a film aperture 32. The printed film aperture is so well integrated with the overall design of the carton, that it is difficult to detect the dispensing aperture in FIG. 2 without the partially dispensed tissue sheet 36 present as shown in FIG. 3. As such, the film aperture 32 does not appear as a discrete colorless transparent window as in FIG. 1. Rather, the film aperture appears as a continuous portion of the carton's exterior.

Figure 4:
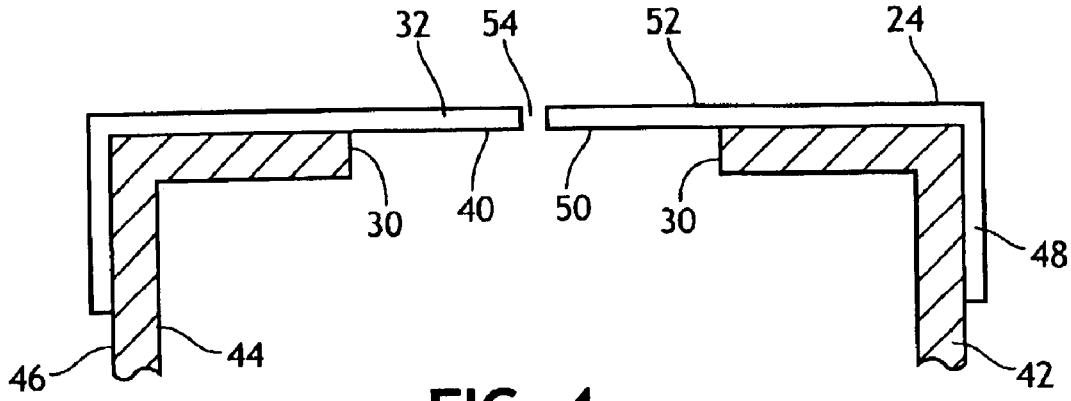
FIG. 4 illustrates a cross-section of one embodiment.

Referring now to FIG. 4, a cross-section of the carton of FIG. 2 is shown taken through the top wall 24 and portions of the side walls. The carton comprises a substrate 42 having an interior surface 44 and an exterior surface 46. In one embodiment, the substrate was a light board or paper material comprising cellulose. However, alternative substrates such as metallic foils, wood, metal, laminates of two or more substrates, and plastics are non-exhaustive possibilities. In one embodiment, laminated to at least a portion of the exterior surface 44, is a film 48 having an inner surface 50 and an outer surface 52. The film can be laminated to the exterior surface by a suitable adhesive or glue or other means known to those of skill in the art.

The film can cover the entire exterior surface 46 of the substrate. If the film covers the majority of the exterior, less expensive substrates can be used since the film provides a smooth uniform surface for printing. Thus, instead of using substrates having a clay coating on the exterior surface or other means to provide a smooth white printing surface, less expensive substrates can be specified instead. Alternatively, the film can be a "cap" covering the top wall 24 or the top wall and a portion of the sidewalls as shown.

The film can comprise a suitable plastic material such as polyethylene, uniaxially oriented high density polyethylene, polypropylene, oriented polypropylene, polyester, polyvinylchloride, or multi-layered structures that can offer other characteristics such as a moisture barrier.

The substrate 42 has a cutout opening 30 that is mostly obscured by the film aperture 32 with its associated dispensing opening 54. The cutout opening 30 can be any desired size or shape, but ordinarily will be either oval or rectangular in shape. The cutout opening can be located anywhere in the carton such as the top wall 24, the bottom wall 29, or any of the sidewalls. Additionally, the cutout opening can comprise portions of two or more walls such as a cutout opening interconnecting portions of the top wall and portions of the sidewall. In one embodiment, the cutout opening was an oval approximately 91 mm long by 66 mm wide located in the top wall 24. In another embodiment, the cutout opening was a rectangle approximately 175 mm long by 55 mm wide having rounded corners. The size of the cutout opening 30 determines a cutout area for the cutout opening. The cutout area can be the same as the dispensing opening's effective open area (defined later herein), but often instead the cutout area is greater than the effective open area.

In order to effectively hide the film aperture 32 so it appears as a continuous part of the carton's exterior, the design 40 can be reverse printed onto the inner surface 50. Thus, portions of the film forming the film aperture 32 can be part of the same continuous design that appears on the outer surface 52 in regions other than the film aperture. Alternatively, it is also possible to print the design on directly the outer surface 52. The design can be any suitable pictorial, graphical, or color combination including an opaque or transparent color. Alternatively, the film aperture could be extruded in a specific color and/or metallized such that the film aperture is no longer a colorless transparent window. The color or metallizing can be incorporated as part of the carton's overall design.

Alternatively, rather than blending the film aperture into the carton's graphics, it is also possible to contrast the film aperture for visual affect. For example, the film aperture can be printed as flower petals such that the partially dispensed tissue sheet 36 would appear as if it is bursting from a flower. The film 48 can also be produced containing holographics, Fresnel lenses, or both in combination, or otherwise produce three-dimensional images. To enhance the three-dimensional affect the inner surface 50 can be metallized as known in the art. In one embodiment, the film aperture comprises a metallized Fresnel lens positioned over the cutout 30 having a dispensing opening 54 cut through the lens.

One company having the ability to produce films containing holographic and/or Fresnel lenses is Cobum Graphic Films, Inc., having an office at 1650 Corporate Road West, Lakewood, N.J. 08701. A tissue carton utilizing these films entitled *Decorative Film, Carton, And Method Of Making*, U.S. Ser. No. 10/374,185 filed with the United States Patent Office on Feb. 25, 2003, and herein incorporated by reference in a consistent manner with the exception of "design" as defined in the Definitions section appearing at page 3, lines 18–21. A design for the purposes of this application can be a solid unvarying color.

All of the above techniques would obscure or prevent viewing of the carton's interior through the previously utilized colorless transparent window. They would transform the colorless transparent window from a discrete element provided for dispensing assistance into an integrated design element that is part of the carton's exterior. As such, more attractive cartons are produced reducing or eliminating the need to hide the tissue carton from view.

While FIG. 4 shows the film 48 laminated to the exterior surface 46, it is also possible to laminate the film to the interior surface 44. In this embodiment, a portion of the design can be printed onto the exterior surface 46 and the remaining portion of the design can be printed onto the film aperture 32. Either the inner surface 50 or the outer surface 52 can be printed. Alternatively, a colored or metallized film can be used to hide the carton's interior from view.

Figure 7:
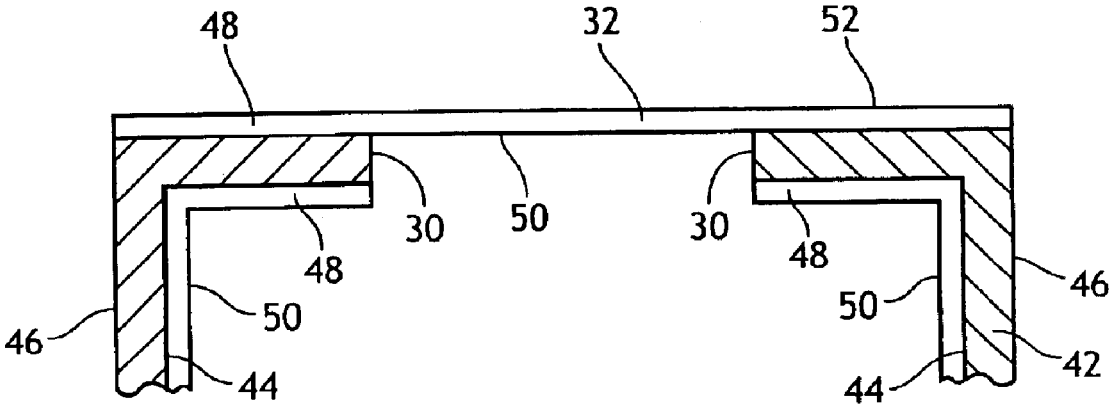
FIG. 7 illustrates another embodiment of the invention.

Referring to FIG. 7, laminating the film to the interior surface 44 or to both the interior and exterior (46) surfaces provides a means to produce a carton suitable for housing wet-wipe products such as a baby wipe, cleaning wipe, bathing cloth, or the like. The films forming the carton's interior and exterior can be the same or different depending on the product the carton is intended to hold and the degree of moisture or chemical resistance required. Additionally, the interior surface 44 can be treated to be moisture impermeable by means of a suitable coating or the substrate 42 can be a moisture impermeable material such as plastic. Other suitable moisture impermeable materials could be multilayer films such as a polyethylene/metallic foil/polyethylene film. Furthermore, if a micro-perfed film aperture 32 or a splittable film forms the film aperture, moisture loss can be minimized or eliminated. If the film is splittable, moisture loss is entirely prevented until the film is split by the consumer to access the product.

Figure 5:
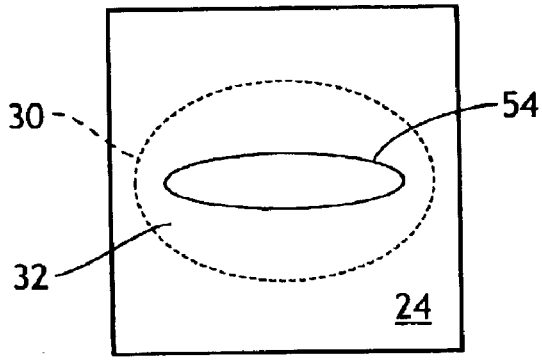
FIG. 5 illustrates one embodiment of the film aperture.
Figure 6:
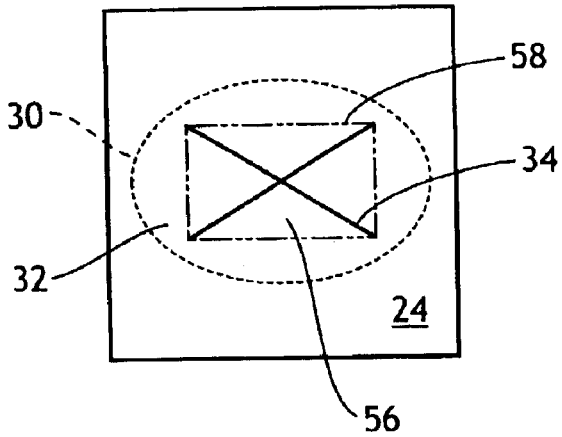
FIG. 6 illustrates another embodiment of the film aperture.

Referring now to FIGS. 5 and 6, alternative dispensing openings 54 within the film aperture 32 are illustrated. Additional suitable dispensing openings are disclosed in U.S. Pat. No. 5,415,320 entitled *Upright Facial Tissue Carton* that issued May 16, 1995 to North et al. and in U.S. Pat. No. 6,053,357 entitled *Pop-Up Tissue And Sheet Dispenser* that issued Apr. 25, 2000 to Yuh; both patents are herein incorporated by reference in a consistent manner. As previously discussed, the cutout opening 30 has a cutout area that can be readily determined from geometry. Similarly, the oval dispensing opening 54 in FIG. 5 has an effective open area that represents the actual physical size of the opening as determined by its geometry.

In FIG. 6, the dispensing opening comprises interconnecting slits 34 in the film. The slits interconnect at an acute angle of approximately 50° to form an X-shaped dispensing opening having a plurality of petals 56. Since the slits are very thin or comprise a perforated line, a dispensing opening is not present in the film aperture 32 until a tissue sheet is dispensed. Upon dispensing a tissue sheet, the petals 56 readily flex to form an effective open area 58 determined by connecting the individual ends of the slits by straight lines. The area of the rectangle or other area as determined by connecting the ends of each slit by straight lines is the effective open area. In one embodiment, the effective open area is about 3 square inches (19 $cm^2$) or greater. In another embodiment, the effective open area is from about 3 to about 6 square inches (19 to 39 $cm^2$). In another embodiment, the effective open area is from about 3 to about 16 square inches (19 to 103 $cm^2$).

The carton of the present invention can be any suitable size or shape to hold tissue, other wet or dry substrates, or personal care articles such as panty liners or incontinence pads. The film aperture 32 can be covered by an additional over-wrap of film or another material, such as board or paper, to better seal the carton during shipping and storage.

In one embodiment, a windowless upright carton measuring approximately 126 mm high by 112 mm wide by 112 mm deep contained a u-shaped clip of interfolded tissue 22. In another embodiment, a windowless flat tissue carton measuring approximately 237 mm long by 122 mm deep by 102 mm high contained a flat clip of interfolded tissue. However, flat tissue cartons are often supplied in various heights depending on the sheet count contained within the carton.

While the figures show an assembled carton containing a tissue product, the present invention extends to a carton blank. One company having the ability to produce carton blanks is Smurfit/Stone Container Corporation having an office at 400 E. North Avenue, Carol Stream, Ill., 60188. The carton blank can be manufactured in one embodiment by reverse printing the film 48, die cutting the substrate 42 to produce a cutout 30, laminating the film to the substrate over the cutout, cutting or perforating the film aperture 32 for the dispensing opening 54 as required, scoring fold lines onto the carton blank, and then die cutting the carton's outline from the laminated substrate. Additional steps as known to those of skill in the art to produce cartons can be used instead of or in combination with the recited steps.

The carton blank can be either flat or partially assembled into a flattened sleeve that is glued or held together. The sleeved carton blank can be provided with end flaps at each of the sleeve's ends for assembling the carton blank into a carton. The carton blank sleeve can be opened and have the flaps on one end folded and sealed shut. The partially assembled carton is then filled with tissue or other items, and then the flaps on the opposite end are folded and sealed shut. The filling sequence can be automated by automatic carton filling equipment if desired.

It will be appreciated that the foregoing description, given for the purposes of illustration, is not to be construed as limiting the scope of the invention, which is defined by the claims and all equivalents thereto.

I claim:

1. A carton blank comprising:

a substrate having an interior surface, an exterior surface and a cutout;

a film having an inner surface, an outer surface, and a film aperture; the film having a design printed onto at least one of the surfaces;

the inner surface of the film adhered to exterior surface of the substrate covering at least a portion of the exterior surface and the cutout; and the film aperture positioned over the cutout.

2. The article of claim 1 wherein the film covers the entire exterior surface.

3. The article of claim 1 wherein the cutout has a cutout area, the film aperture has an effective open area, and the effective open area is less than the cutout area.

4. The article of claim 3 wherein the film aperture has an effective open area of 3 square inches or greater.

5. The article of claim 1 wherein the film aperture comprises interconnecting slits in the film.

6. The article of claim 5 wherein the film aperture comprises two slits that intersect at an acute angle to form an X-shaped dispensing opening.

7. The article of claim 1 wherein a design is printed onto the outer surface including the film aperture.

8. The article of claim 1 wherein a design is reverse printed onto the inner surface including the film aperture.

9. The article of either claim 7 or 8 wherein the design is continuous such that the film aperture appears as a continuous part of the carton blank.

10. The article of claim 1 wherein the carton blank is folded and assembled into a carton.

11. A product comprising:

a substrate forming a carton having an interior surface, exterior surface, and a cutout;

a film having an inner surface, an outer surface, and a film aperture; the film having a design printed onto at least one of the surfaces;

the inner surface of the film adhered to exterior surface of the substrate covering at least a portion of the exterior surface and the cutout;

the film aperture positioned over the cutout; and a plurality of tissue sheets within the carton.

12. The product of claim 11 wherein the film covers the entire exterior surface.

13. The product of claim 11 wherein the cutout has a cutout area, the film aperture has an effective open area, and the effective open area is less than the cutout area.

14. The product of claim 13 wherein the film aperture has an effective open area of 3 square inches or greater.

15. The product of claim 11 wherein the film aperture comprises interconnecting slits in the film.

16. The product of claim 15 wherein the film aperture comprises two slits that intersect at an acute angle to form an X-shaped dispensing opening.

17. The product of claim 11 wherein a design is printed onto the outer surface including the film aperture.

18. The product of claim 11 wherein the design is reverse printed onto the inner surface including the film aperture.

19. The product of either claim 17 or 18 wherein the design is continuous such that the film aperture appears as a continuous part of the carton.

20. The product of claim 11 wherein the carton comprises an upright tissue carton.

21. The product of claim 20 wherein the upright carton contains a u-shaped clip of interfolded tissues.

22. The product of claim 11 wherein the carton comprises a flat tissue carton.

23. The product of claim 22 wherein the carton contains a clip of interfolded tissues.

24. A product comprising:

a windowless tissue carton comprising cellulose containing a plurality of tissue sheets having a film aperture other than a colorless transparent window.

25. The product of claim 24 wherein the film aperture comprises a colored film.

26. The product of claim 24 wherein the film aperture comprises a metallized film.

27. The product of claim 24 wherein the film aperture comprises a printed design.

28. The product of claim 24 wherein the film aperture comprises a Fresnel lens.

29. The product of either claim 25, 26, 27, or 28 wherein the film aperture comprises interconnecting slits.

30. The product of claim 27 wherein the film aperture comprises an outer surface and the design is printed on the outer surface.

31. The product of claim 27 wherein the film aperture comprises an inner surface and the design is reverse printed on the inner surface.

32. The product of claim 27 wherein the carton is formed from a substrate having an interior surface and the film aperture is adhered to at least a portion of the interior surface.

33. The product of claim 27 wherein the carton is formed from a substrate having an exterior surface and the film aperture is adhered to at least a portion of the exterior surface.

34. A product comprising:

a substrate forming a carton having an exterior surface, a moisture impermeable interior surface and a cutout;

a film having an inner surface, an outer surface, and a film aperture; the film having a design printed onto at least one of the surfaces;

the inner surface of the film adhered to exterior surface covering at least a portion of the exterior surface and the cutout;

the film aperture positioned over the cutout; and a plurality of wet wipes within the carton.

35. The product of claim 34 wherein the moisture impermeable interior surface comprises a film layer.

36. The product of claim 34 wherein the inner surface is reverse printed with the design.

37. The product of claim 34 wherein the carton comprises a windowless carton.

38. The product of claim 34 wherein the film aperture is a splitable film.

39. The product of claim 35 wherein the substrate comprises cellulose.

40. A product comprising:

a windowless tissue carton containing a plurality of tissue sheets having a film aperture other than a colorless transparent window and wherein the film aperture comprises a colored film.

41. A product comprising:

a windowless tissue carton containing a plurality of tissue sheets having a film aperture other than a colorless transparent window and wherein the film aperture comprises a metallized film.

42. A product comprising:

a windowless tissue carton containing a plurality of tissue sheets having a film aperture other than a colorless transparent window and wherein the film aperture comprises a Fresnel lens.

43. A product comprising:

a windowless tissue carton containing a plurality of tissue sheets having a film aperture other than a colorless transparent window and wherein the film aperture comprises a printed design.

44. The product of either claim 40, 41, 42, or 43 wherein the film aperture comprises interconnecting slits.

45. The product of claim 43 wherein the film aperture comprises an outer surface and the design is printed on the outer surface.

46. The product of claim 43 wherein the film aperture comprises an inner surface and the design is reverse printed on the inner surface.

47. The product of claim 43 wherein the carton is formed from a substrate having an interior surface and the film aperture is adhered to at least a portion of the interior surface.

48. The product of claim 43 wherein the carton is formed from a substrate having an exterior surface and the film aperture is adhered to at least a portion of the exterior surface.

* * * * *